US009066377B2

(12) United States Patent
Hirano

(10) Patent No.: US 9,066,377 B2
(45) Date of Patent: Jun. 23, 2015

(54) HIGH FREQUENCY COOKING APPARATUS

(75) Inventor: Seiichi Hirano, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 708 days.

(21) Appl. No.: 13/389,621

(22) PCT Filed: Aug. 6, 2010

(86) PCT No.: PCT/JP2010/063365

§ 371 (c)(1),
(2), (4) Date: Feb. 9, 2012

(87) PCT Pub. No.: WO2011/018992

PCT Pub. Date: Feb. 17, 2011

(65) Prior Publication Data

US 2012/0138602 A1 Jun. 7, 2012

(30) Foreign Application Priority Data

Aug. 10, 2009 (JP) ..... 2009-185930

(51) Int. Cl.
*H05B 6/68* (2006.01)
*H05B 6/64* (2006.01)
*H05B 6/66* (2006.01)

(52) U.S. Cl.
CPC ..... *H05B 6/687* (2013.01)

(58) Field of Classification Search
CPC .. G05D 23/1917; H05B 6/6432; H05B 6/745; H05B 6/687; H05B 6/666; H05B 6/6476; H05B 6/6426; H05B 6/642; A21B 1/245
USPC ..... 219/718, 719, 702, 703, 680, 681, 720, 219/715, 506, 492; 126/21 A, 21 R, 39 H, 126/41 R; 323/321, 323, 908
See application file for complete search history.

(56) References Cited

U.S. PATENT DOCUMENTS

| | | | | |
|---|---|---|---|---|
| 4,190,756 | A * | 2/1980 | Foerstner | 219/718 |
| 6,013,908 | A | 1/2000 | Kume et al. | |
| 2007/0278218 | A1 * | 12/2007 | Claesson et al. | 219/681 |

FOREIGN PATENT DOCUMENTS

| | | | |
|---|---|---|---|
| CN | 1208838 | A | 2/1999 |
| JP | 5-174964 | A | 7/1993 |
| JP | 5-205866 | A | 8/1993 |
| JP | 6-20771 | A | 1/1994 |
| JP | 7-217901 | A | 8/1995 |
| JP | 7-260160 | A | 10/1995 |
| JP | 2006-286444 | A | 10/2006 |

* cited by examiner

*Primary Examiner* — Quang Van
(74) *Attorney, Agent, or Firm* — Birch, Stewart, Kolasch & Birch, LLP

(57) ABSTRACT

A high frequency cooking apparatus supplies electric power through a relay contact to a high frequency generator, sets cyclic ON time and OFF time of the relay contact based on set heating time and heating power, and controls the heating power of the high frequency generator. The high frequency cooking apparatus includes a unit for determining whether the time corresponding to the last cycle in the heating time is more than the set ON time of the relay contact, and a unit for increasing the ON time of the relay contact in a cycle just before the last cycle by the ON time of the relay contact in the last cycle and abbreviating the ON time of the relay contact in the last cycle, when the determining unit determines that the time is not more than the set ON time of the relay contact.

8 Claims, 16 Drawing Sheets

FIG. 15

| MENU NO. | COOKING TIME | HEATING POWER (PERCENTAGE) | NUMBER OF TIME FOR COOKING PER DAY | NUMBER OF TIME OF RELAY ON/OFF ACTIONS | | | | |
|---|---|---|---|---|---|---|---|---|
| | | | | CONVENTIONAL CONTROL | | CONTROL ACCORDING TO THE PRESENT INVENTION | | REDUCTION |
| | | | | PER COOKING | PER DAY | PER COOKING | PER DAY | PER DAY |
| 1 | 30 sec | 100% | 50 time | 1 time | 50 time | 1 time | 50 time | 0 time |
| 2 | 35 sec | 80% | 40 time | 2 time | 80 time | 1 time | 40 time | 40 time |
| 3 | 130 sec | 50% | 30 time | 5 time | 150 time | 4 time | 120 time | 30 time |
| 4 | 290 sec | 30% | 20 time | 10 time | 200 time | 9 time | 180 time | 20 time |
| TOTAL PER DAY | 210 min | | 140 time | | 480 time | | 390 time | 90 time |

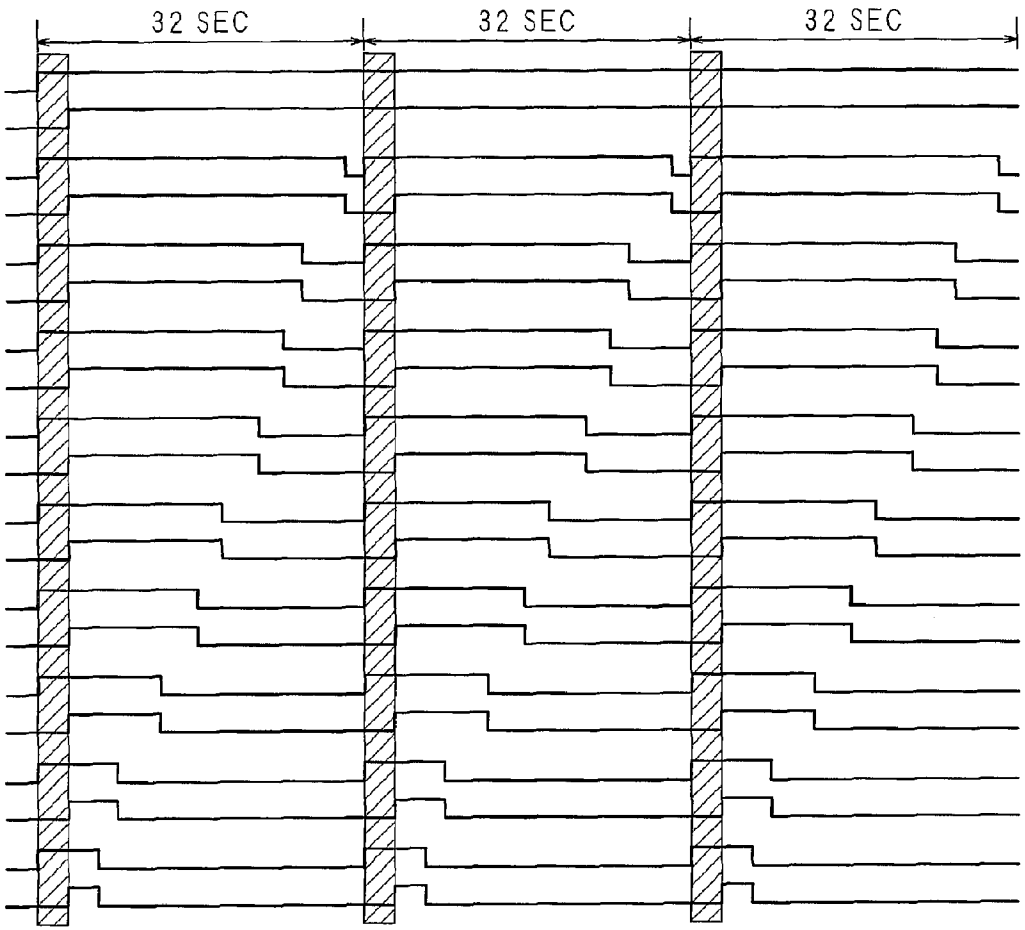
| | (%) POWER | (SEC) ON | (SEC) OFF |
|---|---|---|---|
| FIG. 16A | 100 | 32 | 0 |
| FIG. 16B | 90 | 30 | 2 |
| FIG. 16C | 80 | 26 | 6 |
| FIG. 16D | 70 | 24 | 8 |
| FIG. 16E | 60 | 22 | 10 |
| FIG. 16F | 50 | 18 | 14 |
| FIG. 16G | 40 | 16 | 16 |
| FIG. 16H | 30 | 12 | 20 |
| FIG. 16I | 20 | 8 | 24 |
| FIG. 16J | 10 | 6 | 26 |

HIGH FREQUENCY COOKING APPARATUS

This application is the National Phase of PCT/JP2010/063365 filed on Aug. 6, 2010, which claims priority under U.S.C. 119(a) to Patent Application No. 2009-185930 filed in Japan on Aug. 10, 2009, all of which are hereby expressly incorporated by reference into the present application.

BACKGROUND OF THE INVENTION

1. Field of the Invention

The present invention relates to a high frequency cooking apparatus (microwave oven) that supplies electric power to a high frequency generator (magnetron) through a relay contact, sets a cycle configured with ON time and OFF time for the relay contact based on externally-set heating time and heating power set, and controls a power of a magnetron.

2. Description of Related Art

Recently, it is getting easy to control a commercial-use microwave oven just by selecting one from previously-set recipes (combination of heating time and heating power in accordance with a type and an amount of an object to be heated). The commercial-use microwave oven has high power of high frequency. For adjusting the heating power of the commercial-use microwave oven, a user adjusts time required for cyclically (e.g., 32 second cycle) turning on/off the high frequency oscillation of the magnetron.

FIG. 16 is a timing chart showing examples of ON/OFF time (second) for the power supply of magnetron and ON/OFF time (second) for high frequency oscillation of magnetron in accordance with the heating power (%).

For example, when the heating power is 90% in FIG. 16, the 32 second cycle is repeated in which ON time continues for 30 seconds and OFF time continues for 2 seconds. When the heating power is 60% in FIG. 16, the 32 second cycle is repeated in which ON time continues for 22 seconds and OFF time continues for 10 seconds. The turning on/off of the magnetron is implemented by the turning on/off a relay contact. The hatched portion in FIG. 16 represents oscillation rise time required for the magnetron, and the oscillation rise time does not contribute to heating. It should be noted that the heating power (%) represents a nominal value, and thus may not match to a calculated power.

The relay contact is degraded by the on/off action. Thus, the commercial-use microwave oven is configured to count the number of on/off actions, and to indicate the relay exchange timing when the counted number reaches to a predetermined value. The life of relay is considered in views of a mechanical point and an electrical point. The life in view of the electrical point is considered to correspond to the two hundred thousand times of on/off actions in the commercial-use microwave oven. Regardless of malfunctions, the relay should be exchanged when the counted number of on/off actions reaches to two hundred thousand, for the preventive maintenance.

Patent Document 1 discloses a microwave oven including: a high voltage transformer that actuates a magnetron; a relay that drives the high voltage transformer; a control circuit that outputs a relay drive signal for closing the relay; and a contact detection circuit that detects a condition in which a relay contact is closed. The microwave oven times an operation period from the output of relay drive signal to the closure of relay contact, and stores the operation time in an EEPROM. Then, at the time of starting an operation, the control circuit determines a phase that leads the minimum making current based on the operation time stored in the EEPROM, and outputs the relay drive signal with the determined phase for closing the relay contact.

Patent Document 1: Japanese Patent Application Laid-Open No. H05-205866

SUMMARY OF THE INVENTION

In such a commercial-use microwave oven described above, a power relay of magnetron may be wastefully turned on/off just before the end of heating. It is considered that the wasteful turning on/off causes earlier exchange of relay, because the number of wasteful turning on/off actions are not negligible in the commercial-use microwave oven that is utilized frequently.

Although a stepwise heating is known in which the heating time and heating power are changed in time series for heating, the power relay of magnetron may be wastefully turned on/off at the time of transitioning a step. The number of on/off actions for the transition are also not negligible because the wasteful turning on/off causes earlier exchange of relay.

The present invention is made in view of such circumstances, and has an object to provide a high frequency cooking apparatus that can prevent the wasteful on/off action of relay just before the end of heating and can delay the relay exchange timing.

In addition, the present invention has an object to provide a high frequency cooking apparatus that can prevent the high frequency generator from wastefully turning on/off a power relay at the step transition time of stepwise heating and can delay the relay exchange timing.

A high frequency cooking apparatus according to the present invention supplies electric power to a high frequency generator through a relay contact, sets a cycle of ON time and OFF time for the relay contact based on set heating time and heating power, controls an output of the high frequency generator, and comprises: a determining means for determining whether time for a last cycle in the heating time is not more than the set ON time for the relay contact; and an abbreviating means for increasing the ON time of the relay contact at a cycle before the last cycle by the ON time of the relay contact at the last cycle and abbreviating the ON time of the relay contact at the last cycle, when the determining means determines that the time for the last cycle in the heating time is not more than the set ON time for the relay contact.

In this high frequency cooking apparatus, electric power for the high frequency generator is supplied through the relay contact, the cyclical ON time and OFF time for the relay contact are set in accordance with the set heating time and heating power, and the output of the high frequency generator is controlled. The determining means determines whether the time corresponding to the last cycle in the heating time is not more than the set ON time for the relay contact. When the determining means has determined that the time is not more than the set ON time for the relay contact, the abbreviating means increases the ON time for the relay contact at a cycle just before the last cycle by the period of ON time for the relay contact at the last cycle, and abbreviates the ON time for the relay contact at the last cycle.

A high frequency cooking apparatus according to the present invention supplies electric power to a high frequency generator through a relay contact, sets a pair of ON time and OFF time for the relay contact based on pairs of set heating time and heating power, the pairs continuing in time series to each other, controls an output of the high frequency generator, and comprises: a determining means for determining whether time for a last cycle in the heating time is not more than the set ON time for the relay contact; and an abbreviating means for increasing the ON time of the relay contact at a first cycle in a next pair to the last cycle by the ON time of the relay contact at the last cycle and abbreviating the ON time of the relay contact at the first cycle in the next pair, when the determining means determines that the time for the last cycle in the heating time is not more than the set ON time for the relay contact.

In this high frequency cooking apparatus, the electric power for the high frequency generator is supplied through the relay contact, each pair of cyclic ON time and OFF time for the relay contact is set in accordance with the set pairs of heating time and heating power continuing in time series to each other, and the output of the high frequency generator is controlled. The determining means determines whether the time corresponding to the last cycle in the heating time is not more than the set ON time for the relay contact. When the determining means has determined that the time is not more than the set ON time for the relay contact, the abbreviating means increases the ON time for the relay contact at a first cycle in the next pair by the ON time for the relay contact at the last cycle, and abbreviates the ON time for the relay contact at the last cycle.

A high frequency cooking apparatus according to the present invention supplies electric power to a high frequency generator through a relay contact, sets a pair of ON time and OFF time for the relay contact based on pairs of set heating time and heating power, the pairs continuing in time series to each other, controls an output of the high frequency generator, and comprises: a determining means for determining whether time for a last cycle in the heating time is not more than the set ON time for the relay contact; and an abbreviating means for increasing the ON time of the relay contact at a cycle before the last cycle by the ON time of the relay contact at the last cycle and abbreviating the ON time of the relay contact at the last cycle, when the determining means determines that the time for the last cycle in the heating time is not more than the set ON time for the relay contact.

In this high frequency cooking apparatus, the electric power for the high frequency generator is supplied through the relay contact, each pair of cyclic ON time and OFF time for the relay contact is set in accordance with the set pairs of heating time and heating power continuing in time series to each other, and the output of the high frequency generator is controlled. The determining means determines whether the time corresponding to the last cycle in the heating time is not more than the set ON time for the relay contact. When the determining means has determined that the time is not more than the set ON time for the relay contact, the abbreviating means increases the ON time for the relay contact at a cycle just before the last cycle by the ON time for the relay contact at the last cycle, and abbreviates the ON time for the relay contact at the last cycle.

A high frequency cooking apparatus according to the present invention is configured to subtract time corresponding to an oscillation rise time of the high frequency generator from the ON time when the abbreviating means increases the ON time of the relay contact at the cycle by the ON time of the relay contact at the last cycle.

In this high frequency cooking apparatus, the time corresponding to the oscillation rise time of the high frequency generator is subtracted from the ON time for the relay contact at the last cycle, when the abbreviating means increase the ON time for the relay contact at the cycle just before the last cycle or at the first cycle in the next pair by the ON time for the relay contact at the last cycle.

According to the high frequency cooking apparatus of the present invention, it is possible at the time just before the end of heating to prevent the on/off action of the relay that does not contribute to heating lead by the high frequency generator. Therefore, it is possible to implement the high frequency cooking apparatus that can delay the timing for exchanging the relay.

According to the high frequency cooking apparatus of the present invention, it is possible at the step transition time of the stepwise heating to prevent the power relay of the high frequency generator from performing the on/off action that does not contribute to heating lead by the high frequency generator. Therefore, it is possible to implement the high frequency cooking apparatus that can delay the timing for exchanging the relay.

The above and further objects and features of the invention will more fully be apparent from the following detailed description with accompanying drawings.

BRIEF DESCRIPTION OF THE DRAWINGS

FIG. 15 is a view for explaining a processing performed by the microwave oven according to the present invention.

FIG. 16 is a timing-chart for explaining an example of output (heating) performed by a microwave oven.

DESCRIPTION OF THE PREFERRED EMBODIMENTS

The present invention will be described below in reference to figures that show embodiments according to the present invention.

(Embodiment 1)

Figure 1:
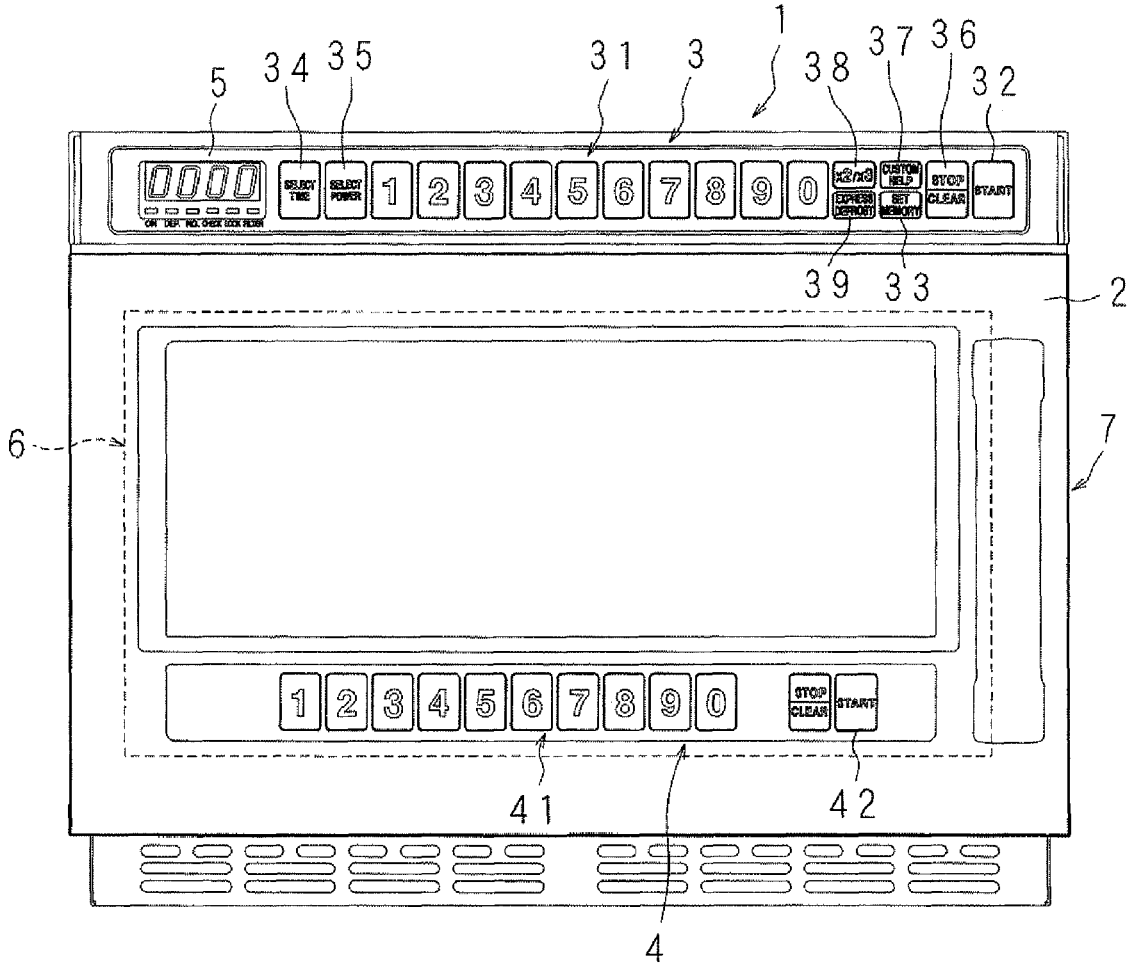
FIG. 1 is a front view showing an outline of an embodiment according to a high frequency cooking apparatus (microwave oven) in the present invention.

FIG. 1 is a front view showing an outline of Embodiment 1 according to a high frequency cooking apparatus (microwave oven) in the present invention.

This microwave oven is configured with a body of oven 1 that is formed in a substantially rectangular parallelepiped shape. The outer shell is a cabinet 7 that contains a heat chamber 6 which has an opening portion at the front. The opening portion of the heat chamber 6 can be covered to be openable and closable by a door 2 that can be opened horizontally and is fixed with a hinge to one side on the front portion of the body of oven 1. The body of oven 1 has a top portion on the front surface which extends forward to cover the top of the door 2. In addition, a control panel 3 is provided on the front surface of the extending top portion of the body of oven 1, and a control panel 4 is provided at the bottom portion of the door 2. The control panels 3, 4 are utilized for accepting a selected recipe, a start instruction of heating and the like, respectively.

The control panel 3 includes: numeric buttons 31 configured with "0" to "9" buttons utilized for selecting a recipe from pre-stored recipes; a start button 32 utilized for accepting a heating start instruction for a recipe corresponding to a numeral of a selected numeric button 31; a stop/clear button 36 utilized for accepting a heating stop instruction; and an indicator 5 that indicates information, such as a content accepted through each button and a remaining time of heating.

The control panel 3 further includes: a setting-storage button 33 utilized for storing a setting of recipe that corresponds to a numeral; a time setting button 34 utilized for accepting a setting of cooking time for the set recipe; and a power setting button 35 utilized for accepting a setting of heating power for the set recipe.

Furthermore, the control panel 3 includes: a help button 37 utilized for displaying a setting content of the stored recipe on the indicator 5; a double/triple setting button 38 utilized for cooking an object whose amount is the double or triple of a predetermined amount for the set recipe; and a quick thawing button 39 utilized for accepting a setting of time for quick thawing.

Figure 2:
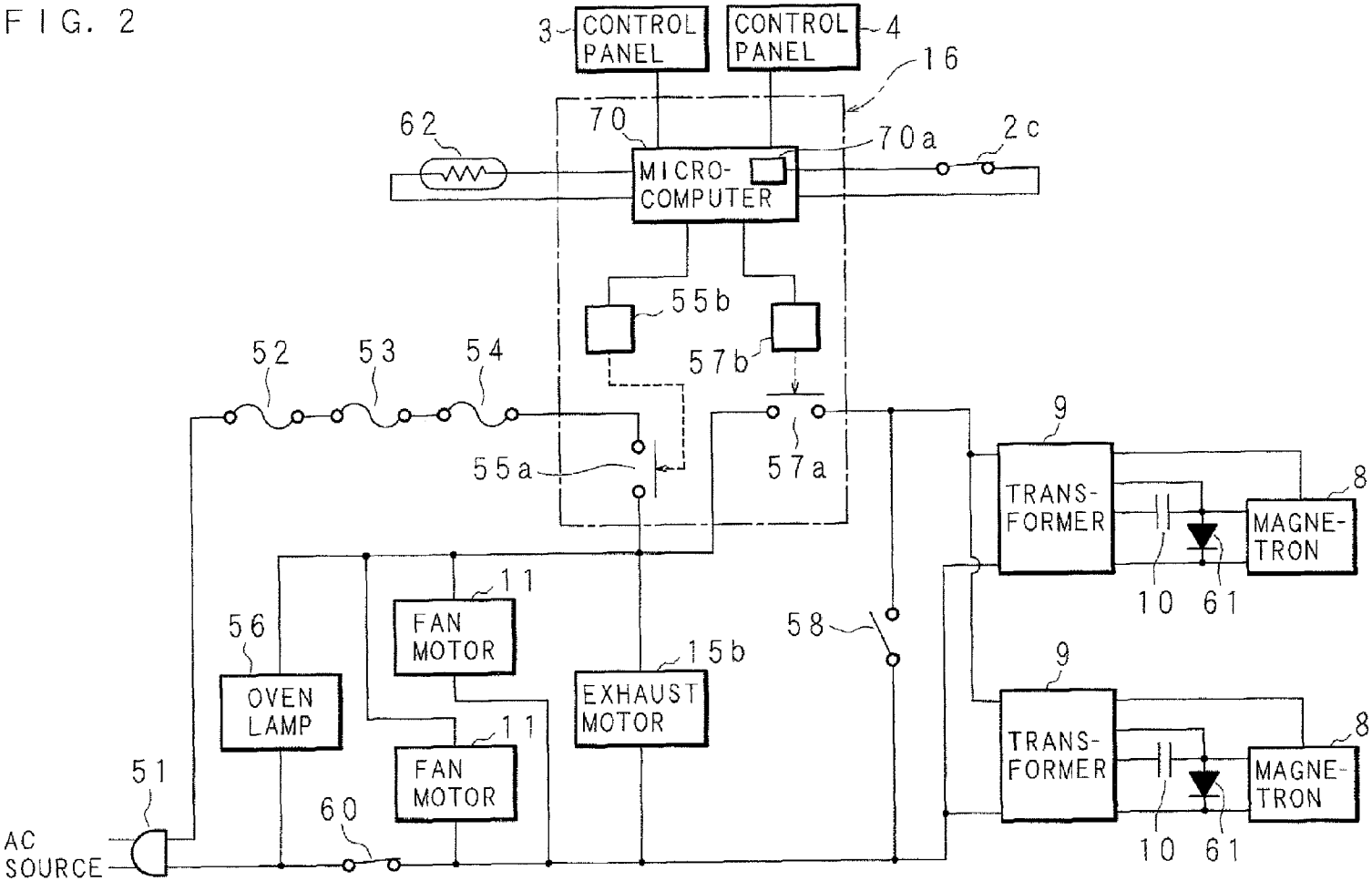
FIG. 2 is a block diagram showing an example of main circuit components configuring the microwave oven according to the present invention.

FIG. 2 is a block diagram showing an example of main circuit components configuring the microwave oven according to the present invention. One of electric terminals connected to a single-phase AC source is connected through a power plug 51, a monitor fuse 52 fused at the ON time of a monitor switch 58 described later, a thermal fuse 53 fused at the time when the inside of heat chamber 6 is at high temperature, thermal fuse 54 fused at the time when magnetrons 8, 8 are at high temperature, and an oven relay contact 55*a* turned on at the heating time of an object to be heated, to one of electric terminals provided to an oven lamp 56 utilized for illuminating inside the heat chamber 6.

One electric terminal of the oven lamp 56 is further connected to each one of electric terminals provided to fan motors 11, 11, an exhaust motor 15*b*, and a relay contact 57*a* for interlock relay which is turned off except when the heating is performed normally. Furthermore, the other electric terminal of the relay contact 57*a* is connected to one of electric terminals provided to the monitor switch 58 that is turned on when the door 2 is opened.

The other one of electric terminals connected to the single-phase AC source is connected through the power plug 51 to the other one of electric terminals provided to the oven lamp 56, and to one of electric terminals provided to an interlock switch 60 that is turned off when the door 2 is opened. Then, the other electric terminal of the interlock switch 60 is connected to each of the other electric terminals provided to the fan motors 11, 11, the exhaust motor 15*b*, and the monitor switch 58.

The other electric terminal of the interlock relay contact 57*a* is connected in parallel to primary sides of two transformers 9, 9. Secondary sides of transformers 9, 9 are connected through capacitors 10, 10 to diodes 61, 61 and magnetrons 8, 8, respectively.

The control unit 16 mainly consists of a microcomputer 70 that is connected to an oven relay drive circuit 55*b*, an interlock relay drive circuit 57*b*, a door switch 2*c*, a humidity sensor 62 which detects humidity inside the heat chamber 6, and two control panels 3, 4.

The microcomputer 70 contains a memory 70*a* having a table that stores a power ON/OFF time (second) and a high frequency oscillation ON/OFF time (second) of the magnetron 8 corresponding to the heating power (%), for example, as shown in FIG. 16.

In this microwave oven, for example, as shown in FIG. 16, 32 second cycle configured with 30 second ON time/2 second OFF time is repeated when the heating power is 90%, and 32 second cycle configured with 22 second ON time/10 second OFF time is repeated when the heating power is 60%. The power ON/OFF of the magnetron 8 is performed by turning on/off the relay contact 57*a*. The hatched portion in the figure represents time (3 seconds) required for the oscillation rise of the magnetron, which does not contribute to heating. It should be noted that the heating power (%) represents a nominal value, and thus may not match with a calculated power.

Figure 3:
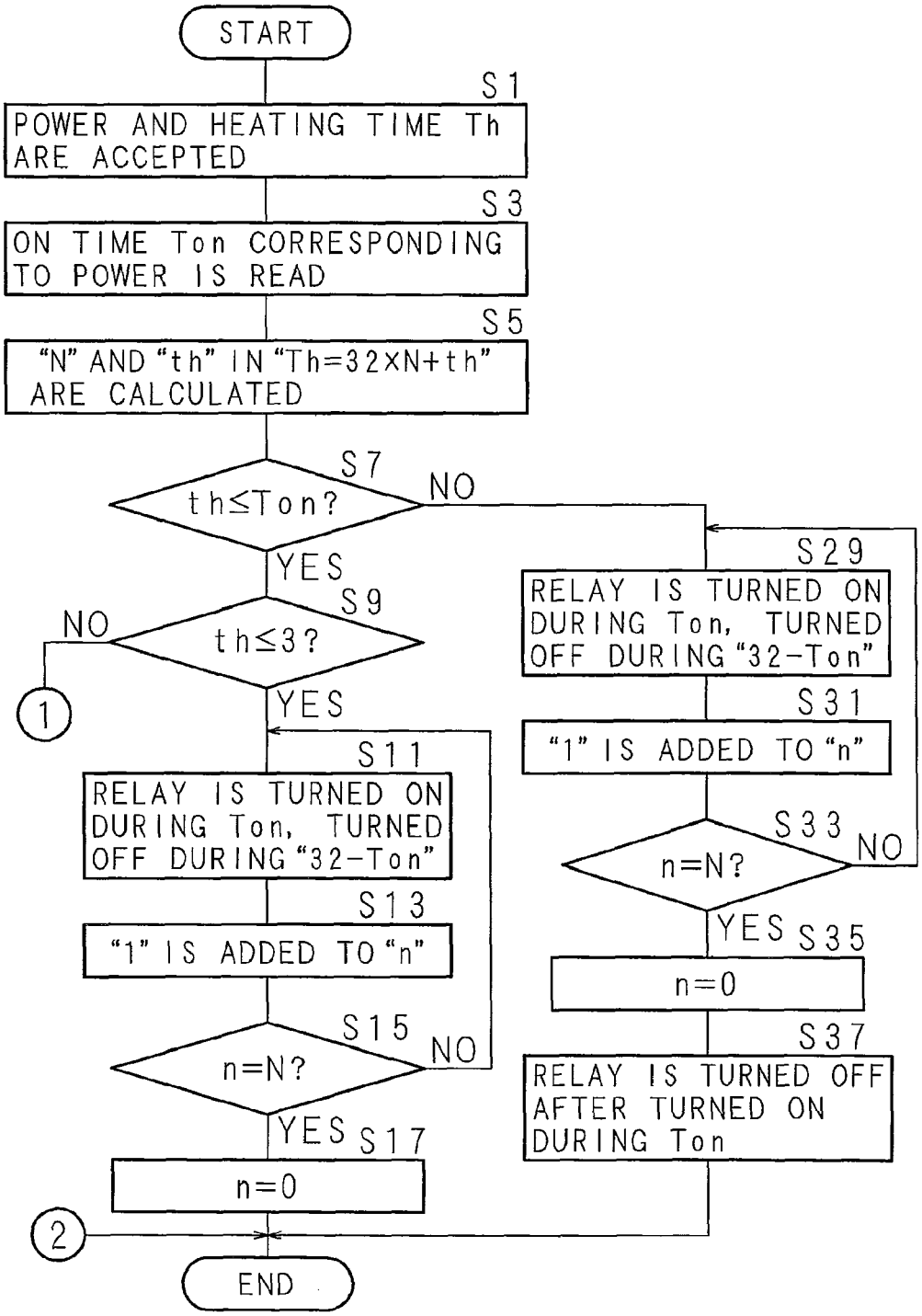
FIG. 3 is a flowchart showing an example of processing performed by the microwave oven according to the present invention.
Figure 4:
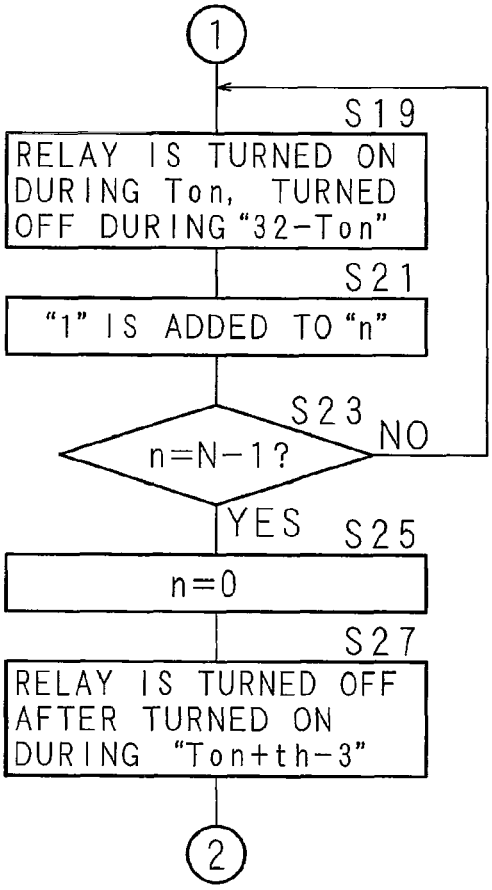
FIG. 4 is a flowchart showing another example of processing performed by the microwave oven according to the present invention.

It will be described below about an example of processing performed by the microwave oven as described above, in reference to flowcharts of FIG. 3 and FIG. 4.

Firstly, the microcomputer 70 of the control unit 16 accepts settings of (heating) power and heating time Th which are input through the control panels 3 and 4 (S1), refers to the table and reads the power ON time Ton of the magnetron 8 (ON time of the interlock relay contact 57*a*) which corresponds to the accepted power (S3). Then, "N" and "th" are calculated, which are utilized in "Th=32×N+th" (S5).

It should be noted that "th" represents heating time at the last cycle (<32 seconds) in the heating time Th and is hereinafter referred to as "last heating time th". In addition, the "N" represents the number of on/off action from which the number of on/off action at the last cycle (one) has been excluded and is hereinafter referred to as "cycle number N".

The microcomputer 70 then determines whether the calculated last heating time th (S5) is more than the ON time Ton or not (S7). When having determined that the calculated last heating time th is not more than the ON time Ton, the microcomputer 70 determines whether the last heating time th is more than 3 seconds or not (S9). In addition, the microcomputer 70 sets "0" as the initial value for a parameter n that stores the number of on/off action of the relay contact 57*a*.

When having determined that the last heating time th is not more than 3 seconds (S9), the microcomputer 70 turns on the relay contact 57*a* (the relay contact 57*a* described below is referred to as just "relay" in flowcharts) during Ton seconds, and then turns off the relay contact 57*a* during "32−Ton" seconds (S11). Then, after adding "1" to the parameter n (S13), the microcomputer 70 determines whether the parameter n is equal to the cycle number N or not (S15). When having determined that the parameter n is not equal to the cycle number N, the microcomputer 70 turns on the relay contact 57*a* during Ton seconds, again, and then turns off the relay contact 57*a* during "32−Ton" seconds (S11).

When having determined that the parameter n is equal to the cycle number N (S15), the microcomputer 70 sets "0" to the parameter n (S17) and ends the heating processing.

Because it is assumed now that the last heating time th is not more than 3 seconds (S9), the turning on of the relay contact 57*a* for the last cycle is abbreviated.

When having determined that the calculated last heating time th (S5) is more than the ON time Ton (S7), the microcomputer 70 turns on the relay contact 57*a* during Ton seconds, and then turns off the relay contact 57*a* during "32−Ton" seconds (S29). Then, after adding "1" to the parameter n (S31), the microcomputer 70 determines whether the parameter n is equal to the cycle number N or not (S33). When having determined that the parameter n is not equal to the cycle number N, the microcomputer 70 turns on the relay contact 57*a* during Ton seconds, again, and then turns off the relay contact 57*a* during "32−Ton" seconds (S29).

When having determined that the parameter n is equal to the cycle number N (S33), the microcomputer 70 sets "0" to the parameter n (S35), turns on the relay contact 57*a* during Ton seconds and then turns off the relay contact 57*a* (S37) for the last cycle, to end the heating processing.

Because it is assumed now that the last heating time th (S5) is more than the ON time Ton, the heating processing is performed conventionally.

Figures 5A, 5B, 5C:
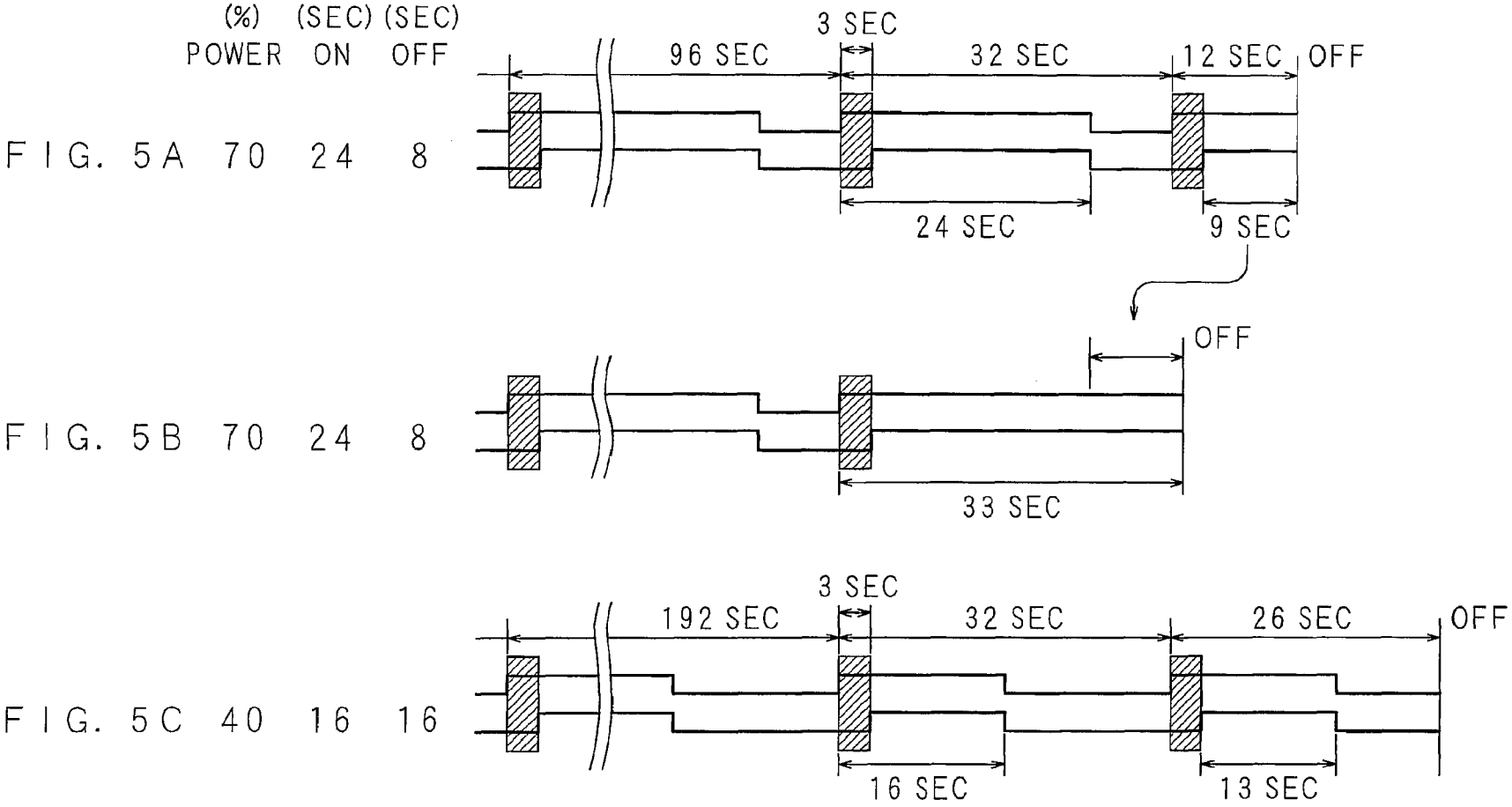
FIG. 5A, FIG. 5B and FIG. 5C are timing-charts showing an example of processing performed by the microwave oven according to the present invention.
Figure 6:
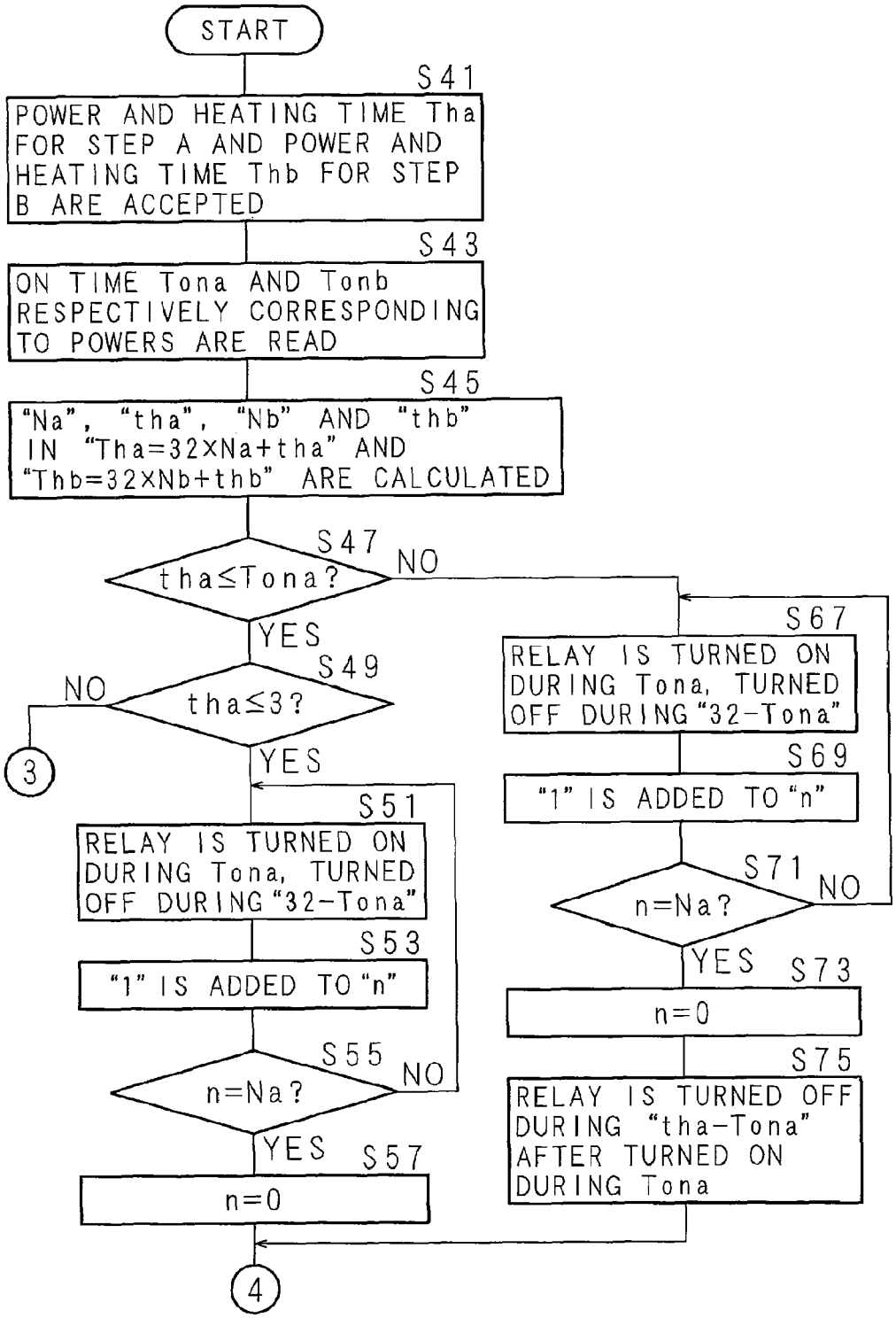
FIG. 6 is a flowchart showing an example of processing in the embodiment performed by the microwave oven according to the present invention.
Figure 7:
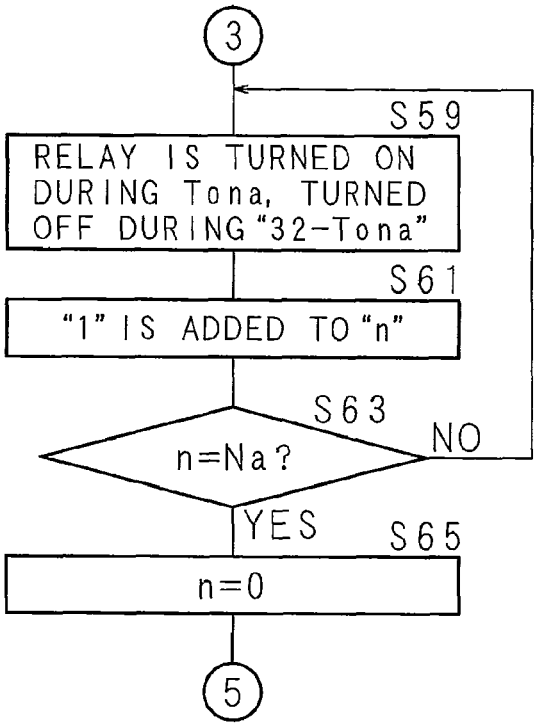
FIG. 7 is another flowchart showing the example of processing in the embodiment performed by the microwave oven according to the present invention.
Figure 8:
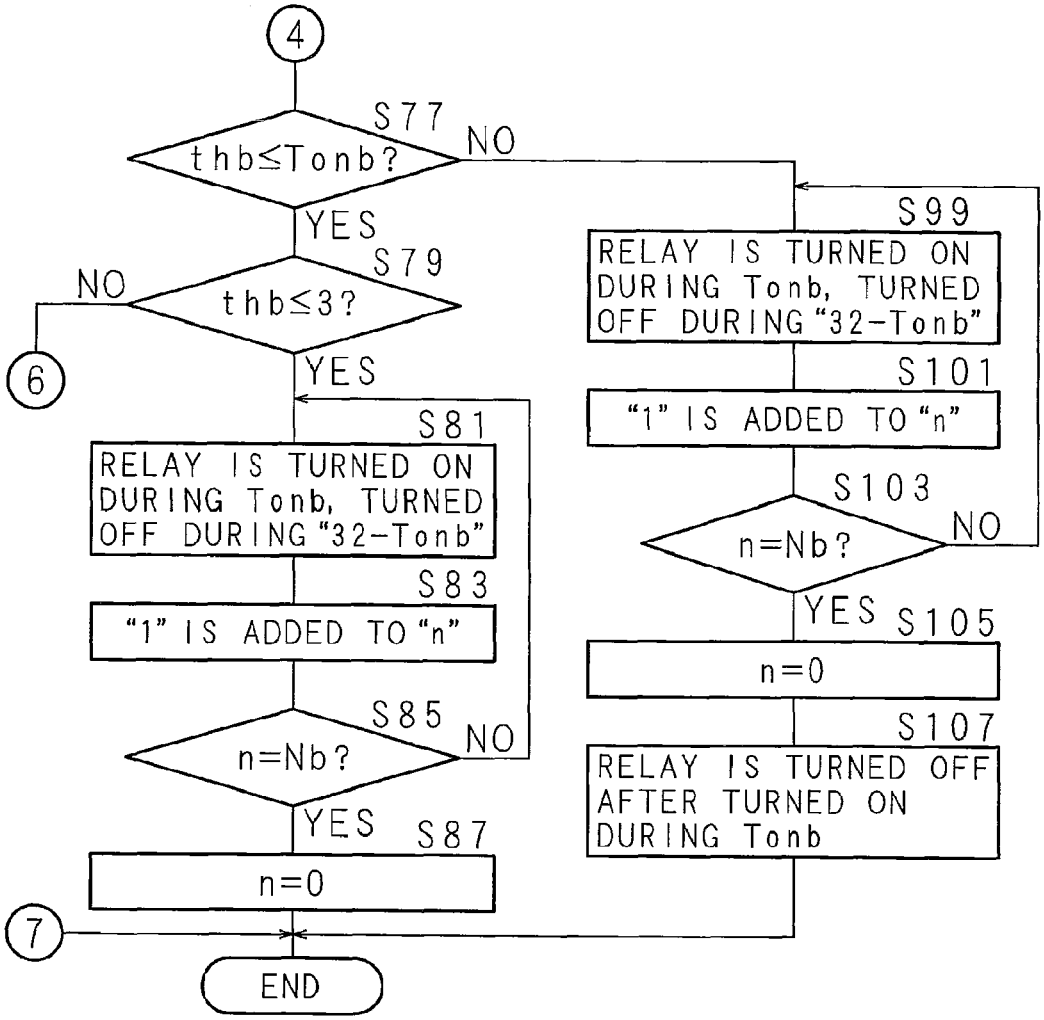
FIG. 8 is another flowchart showing the example of processing in the embodiment performed by the microwave oven according to the present invention.
Figure 9:
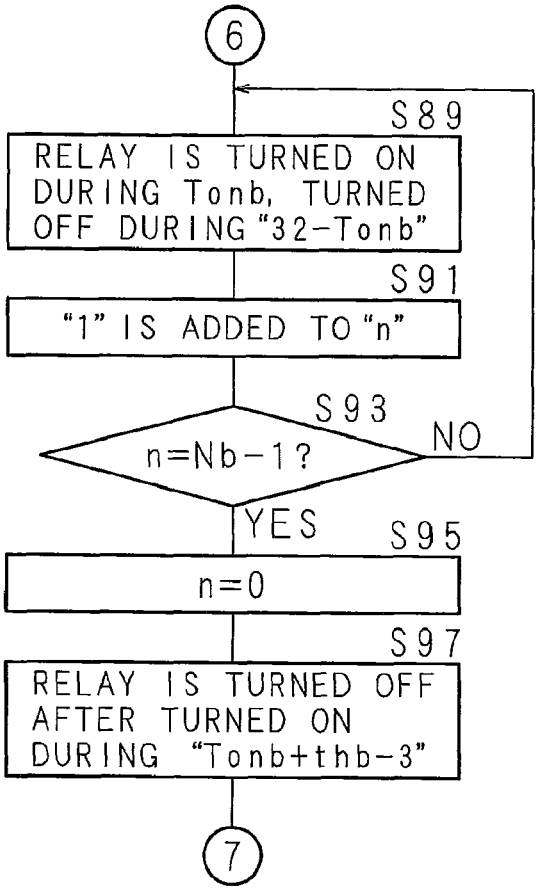
FIG. 9 is another flowchart showing the example of processing in the embodiment performed by the microwave oven according to the present invention.
Figure 10:
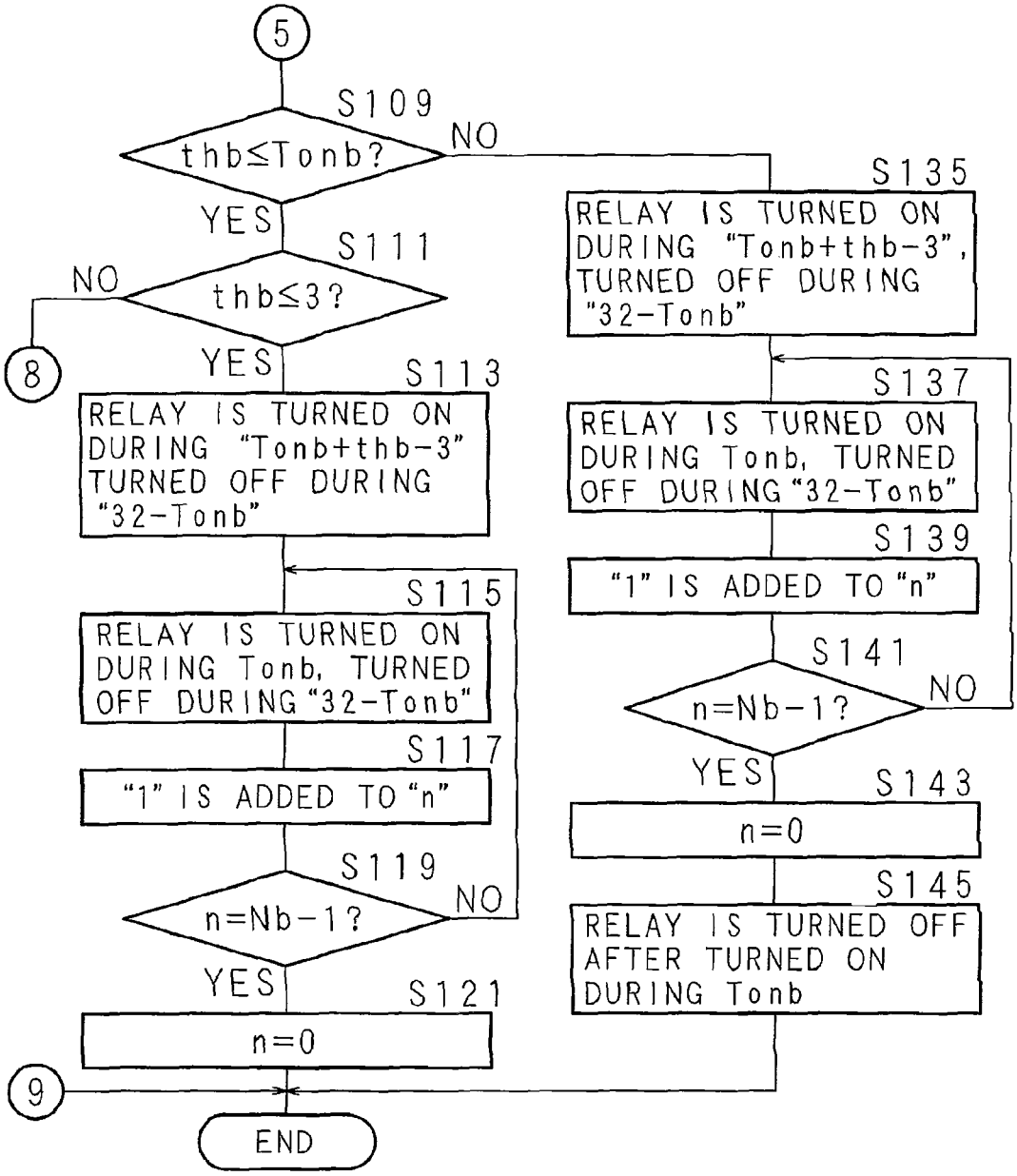
FIG. 10 is another flowchart showing the example of processing in the embodiment performed by the microwave oven according to the present invention.
Figure 11:
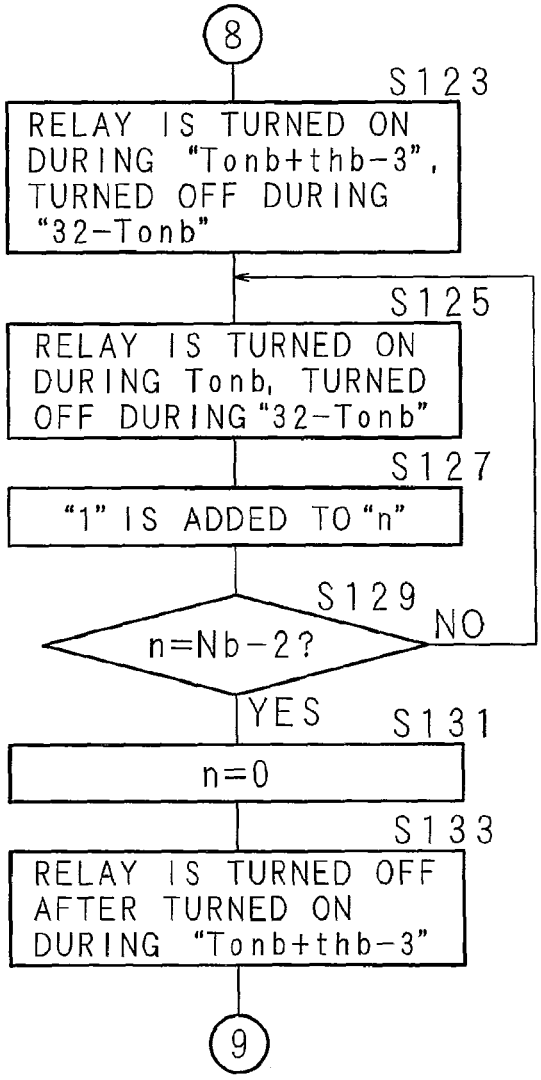
FIG. 11 is another flowchart showing the example of processing in the embodiment performed by the microwave oven according to the present invention.

For example, in the case that the heating is performed during 250 seconds with the power of 40% as shown in FIG. 5C, the relay contact 57*a* is conventionally turned on during 16 seconds at the last cycle, and then the heating processing is ended after the heating time reaches to 250 seconds.

When having determined that the last heating time th is more than 3 seconds (S9), the microcomputer 70 turns on the relay contact 57*a* during Ton seconds and then turns off the relay contact 57*a* during "32−Ton" seconds (S19). Then, the microcomputer 70 adds "1" to the parameter n (S21), and then determines whether the parameter n is equal to the cycle number N−1 or not (S23). When having determined that the parameter n is not equal to the cycle number N−1, the microcomputer 70 turns on the relay contact 57*a* during Ton seconds and then turns off the relay contact 57*a* during "32−Ton" seconds, again (S19).

When having determined that the parameter n is equal to the cycle number N−1 (S23), the microcomputer 70 sets "0" to the parameter n (S25). Then, the microcomputer 70 turns on the relay contact 57*a* during "Ton+th−3" seconds (S27), and then ends the heating processing.

Because it is assumed now that the last heating time th is not more than ON time Ton (S7) but more than 3 seconds (S9), the ON time of the relay contact 57*a* for the last cycle is added to the ON time of the relay contact 57*a* for the cycle just before the last cycle and 3 seconds are subtracted which correspond the oscillation rise time of the magnetron 8, as the oscillation rise time does not contribute to the heating.

For example, in the case that the heating is performed during 140 seconds with the power of 70% as shown in FIG. 5A, the heating is performed during 33 seconds as shown in FIG. 5B, in which twelve seconds have been added to the ON time of the relay contact 57*a* for the cycle just before the last cycle and three seconds corresponding to the oscillation rise time have been subtracted.

(Embodiment 2)

FIGS. 6-11 are flowcharts showing an example of processing in an embodiment 2 performed by the microwave oven according to the present invention. As similar to the configuration of microwave oven according to the present invention explained in the embodiment 1 (see FIG. 1 and FIG. 2), the explanation about the configuration of microwave oven in the embodiment 2 is omitted.

It will be described below about the processing of microwave oven, in reference to the flowcharts of FIGS. 6-10.

This microwave oven performs the stepwise heating that includes steps sequentially performed in time series which are changed in accordance with the heating time and the power.

Firstly, the microcomputer 70 of the control unit 16 accepts, through operation panels 3, 4, the (heating) power and heating time Tha for a step A and the (heating) power and heating time Thb for a step B (S41).

Then, the microcomputer 70 refers to the table and reads the power ON time Tona and power ON time Tonb of the magnetron 8 (ON times of the interlock relay contact 57*a*) which respectively correspond to the accepted powers for the step A and step B (S43). Then, a "Na", "tha", "Nb" and "thb" are calculated, which are utilized in "Tha=32×Na+tha, Thb=32×Nb+thb" (S45).

It should be noted that the "tha" and "thb" represent heating times at the last cycle (<32 seconds) in the heating time Tha and the heating time Thb for the step A and the step B and are hereinafter referred to as the "last heating time tha" and the "last heating time thb", respectively. In addition, the "Na" and "Nb" represent the numbers of on/off actions from which the numbers of on/off actions at the last cycle (one) have been excluded and are hereinafter referred as the "cycle number Na" and the "cycle number Nb", respectively.

Then, the microcomputer 70 determines whether the calculated last heating time tha for the step A (S45) is more than the ON time Tona or not (S47). When having determined that the calculated last heating time tha is not more than the ON time Tona, the microcomputer 70 determines whether the last heating time tha for the step A is more than 3 seconds or not (S49).

When having determined that the last heating time tha is not more than 3 seconds (S49), the microcomputer 70 turns on the relay contact 57*a* during Tona seconds, and then turns off the relay contact 57*a* during "32−Tona" seconds (S51). Then, after adding "1" to the parameter n (S53), the microcomputer 70 determines whether the parameter n is equal to the cycle number Na for the step A or not (S55). When having determined that the parameter n is not equal to the cycle number Na, the microcomputer 70 turns on the relay contact 57*a* during Tona seconds, again, and then turns off the relay contact 57*a* during "32−Tona" seconds (S51).

When having determined that the parameter n is equal to the cycle number Na (S55), the microcomputer 70 sets "0" to the parameter n (S57) and proceeds the processing for the step B.

Because it is assumed now that the last heating time tha for the step A is not more than 3 seconds (S49), the turning on of the relay contact 57*a* for the last cycle is not performed.

When having determined that the calculated last heating time tha for the step A (S45) is more than the ON time Tona (S47), the microcomputer 70 turns on the relay contact 57*a* during Tona seconds, and then turns off the relay contact 57*a* during "32−Tona" seconds (S67). Then, after adding "1" to the parameter n (S69), the microcomputer 70 determines whether the parameter n is equal to the cycle number Na for the step A or not (S71). When having determined that the parameter n is not equal to the cycle number Na, the microcomputer 70 turns on the relay contact 57*a* during Tona seconds, again, and then turns off the relay contact 57*a* during "32–Tona" seconds (S67).

When having determined that the parameter n is equal to the cycle number Na (S71), the microcomputer 70 sets "0" to the parameter n (S73). Subsequently, for the last cycle of the step A, the micro computer 70 turns off the relay contact 57*a* during "tha–Tona" seconds (S75), to proceed the processing for the step B.

Because it is assumed now that the last heating time tha for the step A (S45) is more than the ON time Tona, the heating processing is performed conventionally.

When having determined that the last heating time tha for the step A is not more than 3 seconds (S49), the microcomputer 70 turns on the relay contact 57*a* during Tona seconds and then turns off the relay contact 57*a* during "32–Tona" seconds (S59). Then, the microcomputer 70 adds "1" to the parameter n (S61), and then determines whether the parameter n is equal to the cycle number Na for the step A or not (S63). When having determined that the parameter n is not equal to the cycle number Na, the microcomputer 70 turns on the relay contact 57*a* during Tona seconds and then turns off the relay contact 57*a* during "32–Tona" seconds, again (S59).

When having determined that the parameter n is equal to the cycle number Na (S63), the microcomputer 70 sets "0" to the parameter n (S65) and proceeds the processing for the step B.

Because it is assumed now that the lest heating time tha for the step A is not more than ON time Tona (S47) but more than 3 seconds (S49), the ON time of the relay contact 57*a* for the last cycle in the step A is added to the ON time of the relay contact 57*a* for the first cycle in the step B and 3 seconds are subtracted which correspond the oscillation rise time of the magnetron 8, as the oscillation rise time does not contribute to the heating (which is described later).

When having set "0" to the parameter n (S65) and proceeded to the processing for the step B, the microcomputer 70 determines whether the calculated last heating time thb for the step B (S45) is more than the ON time Tonb or not (S109). When having determined that the calculated last heating time thb is not more than the ON time Tonb, the microcomputer 70 determines whether the last heating time thb for the step B is more than 3 seconds or not (S111).

Then, the microcomputer 70 turns on the relay contact 57*a* during "Tonb+thb–3" seconds, and then turns off the relay contact 57*a* during "32–Tonb" seconds (S113). Then, the microcomputer 70 turns on the relay contact 57*a* during Tonb seconds, and then turns off the relay contact 57*a* during "32–Tonb" seconds (S115). Then, after adding "1" to the parameter n (S117), the microcomputer 70 determines whether the parameter n is equal to the cycle number Nb–1 for the step B or not (S119). When having determined that the parameter n is not equal to the cycle number Nb–1, the microcomputer 70 turns on the relay contact 57*a* during Tonb seconds, again, and then turns off the relay contact 57*a* during "32–Tonb" seconds (S115).

When having determined that the parameter n is equal to the cycle number Nb–1 (S119), the microcomputer 70 sets "0" to the parameter n (S121) and ends the heating processing.

Because it is assumed now that the last heating time thb for the step B is not more than 3 seconds (S111), the turning on of the relay contact 57*a* for the last cycle in the step B is not performed.

When having determined that the calculated last heating time thb for the step B (S45) is more than the ON time Tonb (S109), the microcomputer 70 turns on the relay contact 57*a* during "Tonb+thb–3" seconds, and then turns off the relay contact 57*a* during "32–Tonb" seconds (S135). Then, the microcomputer 70 turns off the relay contact 57*a* during "32–Tonb" seconds after truing on during Tonb seconds (S137). Then, after adding "1" to the parameter n (S139), the microcomputer 70 determines whether the parameter n is equal to the cycle number Nb–1 for the step B or not (S141). When having determined that the parameter n is not equal to the cycle number Nb–1, the microcomputer 70 turns on the relay contact 57*a* during Tonb seconds, again, and then turns off the relay contact 57*a* during "32–Tonb" seconds (S137).

When having determined that the parameter n is equal to the cycle number Nb–1 (S141), the microcomputer 70 sets "0" to the parameter n. (S143). Subsequently, for the last cycle of the step B, microcomputer 70 turns on the relay contact 57*a* during Tonb seconds and then turns off the relay contact 57*a* (S145) for the last cycle of the step B, to end the heating processing.

Because it is assumed now that the last heating time thb for the step B (S45) is more than the ON time Tonb (S111), the heating processing is ended conventionally.

When having determined that the last heating time thb for the step B is more than 3 seconds (S111), the microcomputer 70 turns on the relay contact 57*a* during "Tonb+thb–3" seconds and then turns off the relay contact 57*a* during "32–Tonb" seconds (S123). Then, the microcomputer 70 turns off the relay contact 57*a* during "32–Tonb" seconds after turning on during Tonb seconds (S125). Then, the microcomputer 70 adds "1" to the parameter n (S127), and then determines whether the parameter n is equal to the cycle number Nb–2 or not (S129). When having determined that the parameter n is not equal to the cycle number Nb–2, the microcomputer 70 turns on the relay contact 57*a* during Tonb seconds and then turns off the relay contact 57*a* during "32–Tonb" seconds, again (S125).

When having determined that the parameter n is equal to the cycle number Nb–2 (S129), the microcomputer 70 sets "0" to the parameter n (S131). Then, the microcomputer 70 turns on the relay contact 57*a* during "Tonb+thb–3" seconds (S133), and then ends the heating processing.

Because it is assumed now that the last heating time thb is not more than ON time Tonb (S109) but more than 3 seconds (S111), the ON time of the relay contact 57*a* for the last cycle in the step B is added to the ON time of the relay contact 57*a* for the cycle just before the last cycle and 3 seconds are subtracted which correspond to the oscillation rise time of the magnetron 8, as the oscillation rise time does not contribute to the heating.

When having set "0" to the parameter n (S57) and proceeded the processing for the step B, or when having turned on the relay contact 57*a* during Tona seconds, turned off during "tha–Tona" seconds (S75) and then proceeded the processing for the step B, the microcomputer 70 determines whether the calculated last heating time thb for the step B (S45) is more than the ON time Tonb or not (S77). When having determined that the calculated last heating time thb for the step B is not more than the ON time Tonb, the microcomputer 70 determines whether the last heating time thb is more than 3 seconds or not (S79).

Then, the microcomputer 70 turns on the relay contact 57*a* during Tonb seconds, and then turns off the relay contact 57*a* during "32–Tonb" seconds (S81). Then, after adding "1" to the parameter n (S83), the microcomputer 70 determines whether the parameter n is equal to the cycle number Nb for the step B or not (S85). When having determined that the parameter n is not equal to the cycle number Nb, the microcomputer 70 turns on the relay contact 57*a* during Tonb seconds, again, and then turns off the relay contact 57*a* during "32−Tonb" seconds (S81).

When having determined that the parameter n is equal to the cycle number Nb (S85), the microcomputer 70 sets "0" to the parameter n (S87) and ends the heating processing.

Because it is assumed now that the last heating time thb for the step B is not more than 3 seconds (S79), the turning on of the relay contact 57*a* for the last cycle in the step B is not performed.

When having determined that the calculated last heating time thb for the step B (S45) is more than the ON time Tonb (S77), the microcomputer 70 turns on the relay contact 57*a* during Tonb seconds, and then turns off the relay contact 57*a* during "32−Tonb" seconds (S99). Then, after adding "1" to the parameter n (S101), the microcomputer 70 determines whether the parameter n is equal to the cycle number Nb for the step B or not (S103). When having determined that the parameter n is not equal to the cycle number Nb, the microcomputer 70 turns on the relay contact 57*a* during Tonb seconds, again, and then turns off the relay contact 57*a* during "32−Tonb" seconds (S99).

When having determined that the parameter n is equal to the cycle number Nb (S103), the microcomputer 70 sets "0" to the parameter n (S105), turns on the relay contact 57*a* during Tonb seconds and then turns off the relay contact 57*a* (S107) for the last cycle of the step B, to end the heating processing.

Because it is assumed now that the last heating time thb for the step B (S45) is more than the ON time Tonb (S77), the heating processing is ended conventionally.

When having determined that the last heating time thb for the step B is more than 3 seconds (S79), the microcomputer 70 turns on the relay contact 57*a* during Tonb seconds and then turns off the relay contact 57*a* during "32−Tonb" seconds (S89). Then, the microcomputer 70 adds "1" to the parameter n (S91), and then determines whether the parameter n is equal to the cycle number Nb−1 for the step B or not (S93). When having determined that the parameter n is not equal to the cycle number Nb−1, the microcomputer 70 turns on the relay contact 57*a* during Tonb seconds and then turns off the relay contact 57*a* during "32−Tonb" seconds, again (S89).

When having determined that the parameter n is equal to the cycle number Nb−1 (S93), the microcomputer 70 sets "0" to the parameter n (S95). Then, the microcomputer 70 turns on the relay contact 57*a* during "Tonb+thb−3" seconds, turns off the relay contact 57*a* (S97), and then ends the heating processing.

Because it is assumed now that the last heating time thb is not more than ON time Tonb (S77) but more than 3 seconds (S79), the ON time of the relay contact 57*a* for the last cycle in the step B is added to the ON time of the relay contact 57*a* for the cycle just before the last cycle and 3 seconds are subtracted which correspond to the oscillation rise time of the magnetron 8, as the oscillation rise time does not contribute to the heating.

Figure 14A:
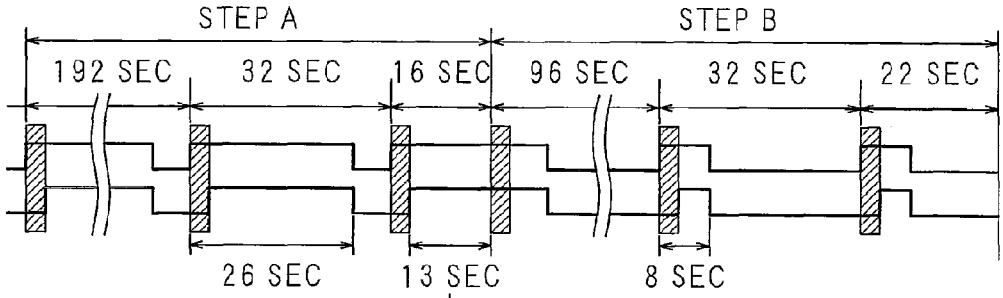
FIG. 14A, FIG. 14B and FIG. 14C are timing-charts showing an example of processing performed by the microwave oven according to the present invention.
Figure 14B:
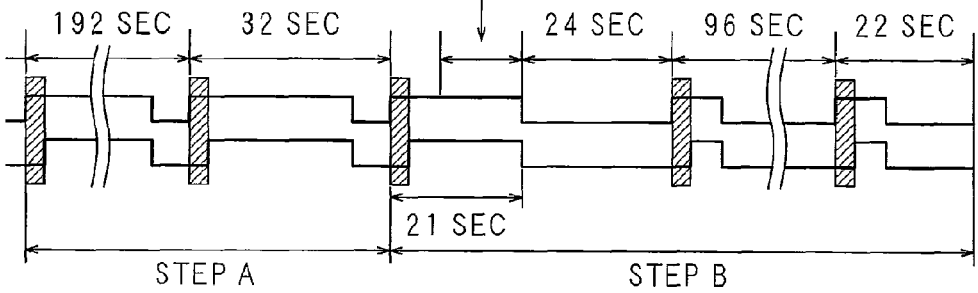

For example, in the case of Embodiment 2 that the heating step A is performed during 240 seconds with the power of 80% and the heating step B is sequentially performed during 150 seconds with the power of 20% as shown in FIG. 14A, the heating is performed during 21 seconds as shown in FIG. 14B, in which sixteen seconds of the last cycle in the step A have been added to the ON time (8 seconds) of the relay contact 57*a* for the first cycle of the next step B and three seconds corresponding to the oscillation rise time have been subtracted.

(Embodiment 3)

Figure 12:
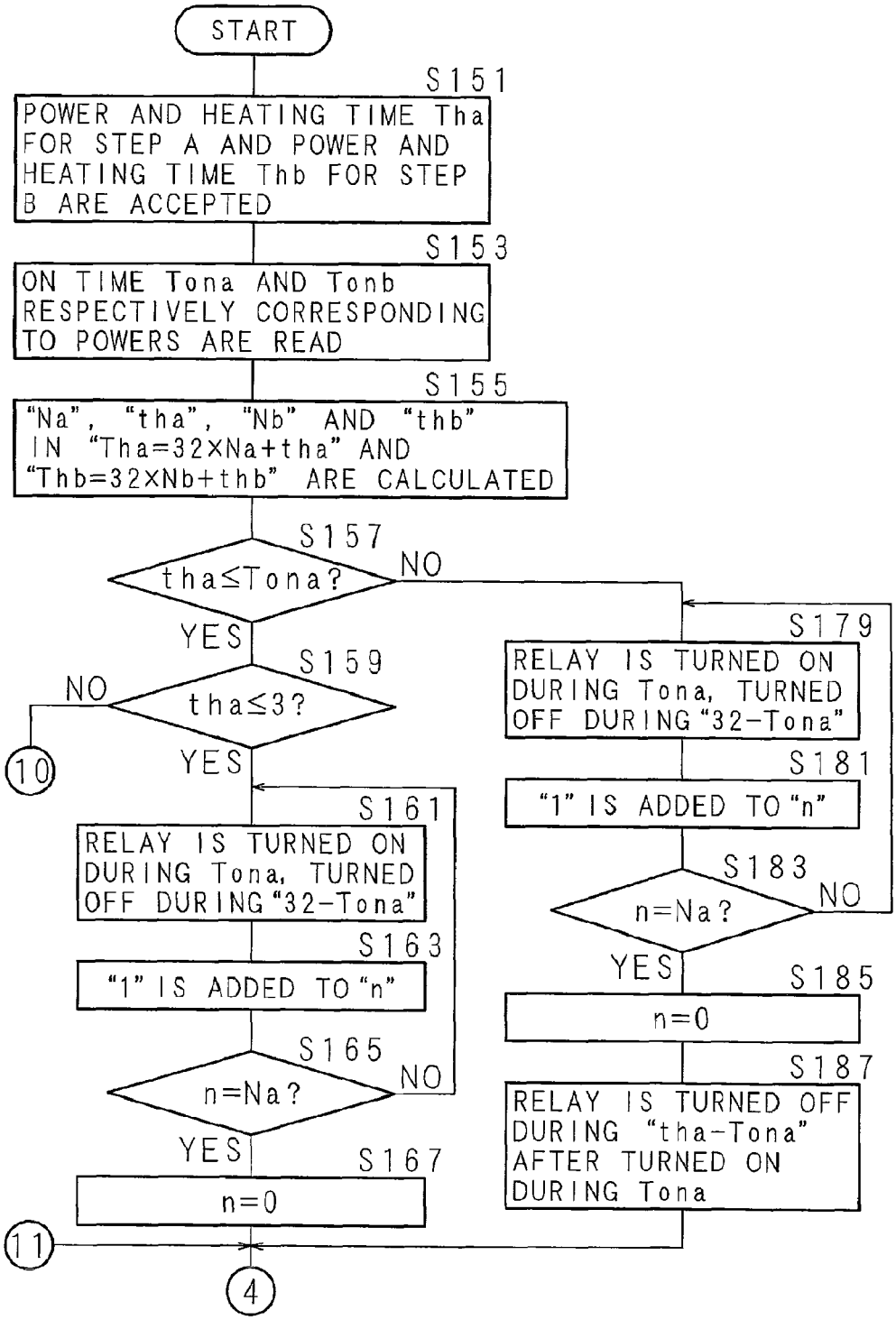
FIG. 12 is a flowchart showing an example of processing in another embodiment performed by the microwave oven according to the present invention.
Figure 13:
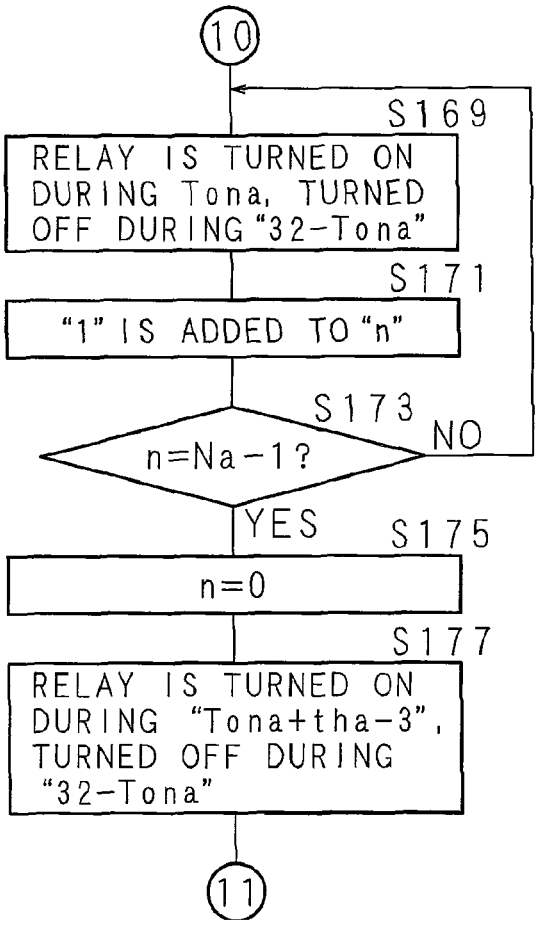
FIG. 13 is another flowchart showing the example of processing in another embodiment performed by the microwave oven according to the present invention.

FIG. 12 and FIG. 13 are flowcharts showing an example of processing in an embodiment 3 performed by the microwave oven according to the present invention. As similar to the configuration of microwave oven according to the present invention explained in the embodiment 1 (see FIG. 1, and FIG. 2), the explanation about the configuration of microwave oven in the embodiment 3 is omitted.

It will be described below about the processing of microwave oven, in reference to the flowcharts of FIG. 12 and FIG. 13.

This microwave oven performs the stepwise heating that includes steps connected in time series which are changed in accordance with the heating time and the power.

Firstly, the microcomputer 70 of the control unit 16 accepts the (heating) power and heating time Tha for a step A and the (heating) power and heating time Thb for a step B (S151).

Then, the microcomputer 70 reads the power ON time Tona and power ON time Tonb of the magnetron 8 (ON times of the interlock relay contact 57*a*) which respectively correspond to the accepted powers for the step A and step B (S153). Then, a "Na", "tha", "Nb" and "thb" are calculated, which are utilized in "Tha=32×Na+tha, Thb=32×Nb+thb" (S155).

It should be noted that the "tha" and "thb" represent heating times at the last cycle (<32 seconds) in the heating time Tha and the heating time Thb for the step A and the step B and are i.e., the "last heating time tha" and the "last heating time thb", respectively. In addition, the "Na" and "Nb" represent the numbers of on/off action from which the numbers of on/off action at the last cycle (one) have been excluded and are i.e., the "cycle number Na" and the "cycle number Nb", respectively.

Then, the microcomputer 70 determines whether the calculated last heating time tha for the step A (S155) is more than the ON time Tona or not (S157). When having determined that the calculated last heating time tha is not more than the ON time Tona, the microcomputer 70 determines whether the last heating time tha for the step A is more than 3 seconds or not (S159).

When having determined that the last heating time tha is not more than 3 seconds (S159), the microcomputer 70 turns on the relay contact 57*a* during Tona seconds, and then turns off the relay contact 57*a* during "32−Tona" seconds (S161). Then, after adding "1" to the parameter n (S163), the microcomputer 70 determines whether the parameter n is equal to the cycle number Na for the step A or not (S165). When having determined that the parameter n is not equal to the cycle number Na, the microcomputer 70 turns on the relay contact 57*a* during Tona seconds, again, and then turns off the relay contact 57*a* during "32−Tona" seconds (S161).

When having determined that the parameter n is equal to the cycle number Na (S165), the microcomputer 70 sets "0" to the parameter n (S167) and proceeds the processing for the step B.

Because it is assumed now that the last heating time tha is not more than 3 seconds (S159), the turning on of the relay contact 57*a* for the last cycle is not performed.

When having determined that the calculated last heating time tha for the step A (S155) is more than the ON time Tona (S157), the microcomputer 70 turns on the relay contact 57*a* during Tona seconds, and then turns off the relay contact 57*a* during "32−Tona" seconds (S179). Then, after adding "1" to the parameter n (S181), the microcomputer 70 determines whether the parameter n is equal to the cycle number Na for the step A or not (S183). When having determined that the parameter n is not equal to the cycle number Na, the microcomputer 70 turns on the relay contact 57*a* during Tona seconds, again, and then turns off the relay contact 57*a* during "32−Tona" seconds (S179).

When having determined that the parameter n is equal to the cycle number Na (S183), the microcomputer 70 sets "0" to the parameter n (S185), turns on the relay contact 57*a* during Tona seconds and then turns off the relay contact 57*a* during "tha−Tona" seconds for the last cycle of the step A (S187), to proceed the processing for the step B.

Because it is assumed now that the last heating time tha (S155) is more than the ON time Tona, the heating processing is performed conventionally.

When having determined that the last heating time tha for the step A is not more than 3 seconds (S159), the microcomputer 70 turns on the relay contact 57*a* during Tona seconds and then turns off the relay contact 57*a* during "32−Tona" seconds (S169). Then, the microcomputer 70 adds "1" to the parameter n (S171), and then determines whether the parameter n is equal to the cycle number Na−1 for the step A or not (S173). When having determined that the parameter n is not equal to the cycle number Na−1, the microcomputer 70 turns on the relay contact 57*a* during Tona seconds and then turns off the relay contact 57*a* during "32−Tona" seconds, again (S169).

When having determined that the parameter n is equal to the cycle number Na−1 (S173), the microcomputer 70 sets "0" to the parameter n (S175), turns off the relay contact 57*a* during "32−Tona" seconds after turning on during "Tona+tha−3" seconds (S177), and then proceeds the processing for the step B. Because it is assumed now that the last heating time tha for the step A is not more than ON time Tona (S157) but more than 3 seconds (S159), the ON time of the relay contact 57*a* for the last cycle in the step A is added to the ON time of the relay contact 57*a* for the cycle just before the last cycle and 3 seconds are subtracted which correspond the oscillation rise time of the magnetron 8, as the oscillation rise time does not contribute to the heating. Therefore, the last cycle for the step A is not performed.

When having set "0" to the parameter n (S167) or when having turned off the relay contact 57*a* during "32−Tona" seconds after turning on during "Tona+tha−3" seconds, the microcomputer 70 proceeds the processing for the next step B. In addition, when having turned off the relay contact 57*a* after turning on during "tha−Tona" seconds (S187), the microcomputer 70 proceeds the processing for the next step B. The processing performed by the microcomputer 70 for the next step B is similar to the processing at the step S77 to S107 explained in the embodiment 2. Thus, the explanation about the processing is omitted.

Figure 14C:
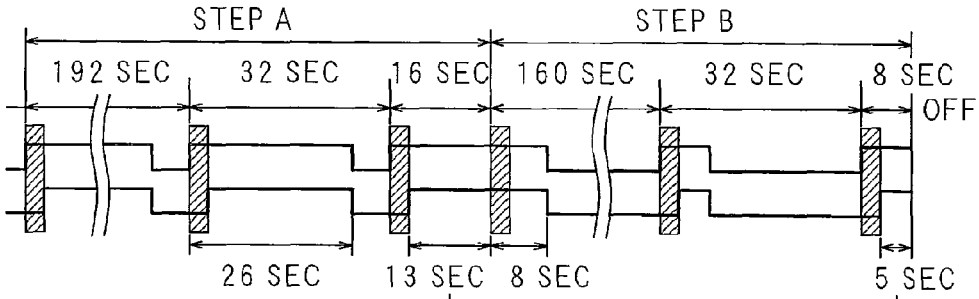
Figure 14D:
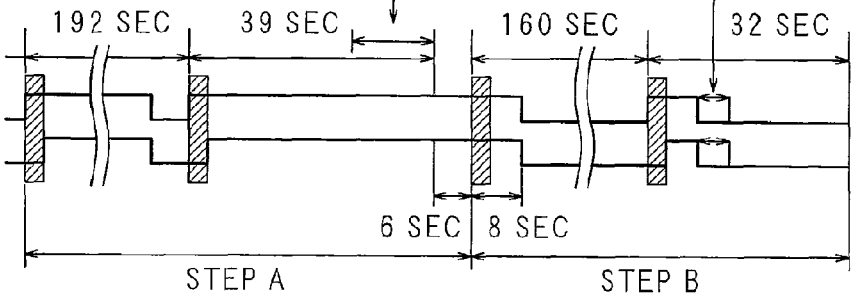

For example, if the last heating time of 16 seconds for the step A is not more than 26 seconds but more than 3 seconds, as shown in FIG. 14(*d*), in the case that the heating step A is performed during 240 seconds with the power 80% and the heating step B is sequentially performed during 200 seconds with the power 20% as shown in FIG. 14C, the heating is performed during 39 seconds as shown in FIG. 14D, in which sixteen seconds of the last cycle in the step A have been added to the ON time (26 seconds) of the relay contact 57*a* for the cycle just before the last cycle and three seconds corresponding to the oscillation rise time have been subtracted. Thus, the last cycle for the step A is not performed.

In the microwave oven according to the present invention, the ON time of the relay contact 57*a* for the last cycle of heating or stepwise heating is added to the ON time of the relay contact 57*a* for the cycle before and after the last cycle, and the on/off action of the relay contact 57*a* for the last cycle is not performed. Therefore, it is possible to reduce the number of on/off actions of the relay contact 57*a*, and to increase the interval for exchanging the relay.

It will be considered below about improvements in the commercial-use microwave oven. FIG. 15 shows an example of estimation for one day, in which cooking time is 210 minutes and the number of cooking times is 140. Thus, the number of on/off actions in the conventional microwave oven is estimated to be 480 in one day, but the number of on/off actions in the microwave oven according to the present invention is estimated to 390 in one day. Hence, about 90 on/off actions are reduced in one day. Therefore, it is considered that the relay exchange interval is increased by about 23%. When the relay is exchanged for the preventive maintenance because the counted number of on/off actions reaches to two hundred thousand, the exchange timing may come on the $417^{th}$ day for the conventional microwave oven, but on the $513^{th}$ day for the microwave oven according to the present invention. In short, the relay exchange interval will be advantageously increased by more than 90 days.

The present invention may be applied to a high frequency cooking apparatus (microwave oven) that supplies electric power through a relay contact to a magnetron, sets a cycle configured with ON time and OFF time of the relay contact based on externally set heating time and heating power, and controls the power of magnetron.

EXPLANATION OF ITEM NUMBERS

1 body of (microwave) oven
2 door
2*c* door switch
3 control panel
4 control panel
5 indicator
6 heat chamber
7 cabinet
8 magnetron (high frequency generator)
16 control unit
31, 41 numeric button
32, 42 start button
33 setting-storage button
70 microcomputer (determining means, abbreviating means)
70*a* memory

The invention claimed is:

1. A high frequency cooking apparatus for performing cooking comprising:

a high frequency generator that generates a high frequency to perform heating;

a power source that supplies electric power to the high frequency generator;

a relay contact that relays the electric power supplied from the power source to the high frequency generator;

a cooking time setting unit that sets time of the cooking;

an on/off cycle setting unit that sets an on/off cycle configured with an ON time during which the relay contact is turned on and an OFF time during which the relay contact is turned off;

a control unit that cyclically turns on and off the relay contact based on the on/off cycle to control the heating performed by the high frequency generator;

a calculation unit that calculates a remainder time of the time of the cooking divided by the on/off cycle; and a determination unit that determines whether the remainder time is more than the ON time or not, wherein when the determination unit determines that the remainder time is not more than the ON time, the control unit adds the remainder time determined to be not more than the ON time onto an ON time in a last on/off cycle within the time of the cooking and continuously maintains the relay contact on for a period of a total of the ON time and the remainder time when the ON time in the set on/off cycle is less than 100% of the on/off cycle.

2. A high frequency cooking apparatus according to claim 1, further comprising:

an accepting unit that accepts a power of the heating performed by the high frequency generator, wherein the ON time and the OFF time are set in accordance with the time of the cooking and the power of the heating.

3. A high frequency cooking apparatus according to claim 1, wherein when the determination unit determines that the remainder time is more than the ON time, the control unit modifies an OFF time in a last on/off cycle within the time of the cooking to be the remainder time determined to be more than the ON time from which the ON time has been subtracted.

4. A high frequency cooking apparatus according to claim 1, wherein the cooking time setting unit sets another time of the cooking, the on/off cycle setting unit sets another on/off cycle configured with another ON time during which the relay contact is turned on and another OFF time during which the relay contact is turned off, the calculation unit calculates another remainder time of said another time of the cooking divided by said another on/off cycle, the determination unit determines whether said another remainder time is more than said another ON time or not, the control unit performs controlling for said another time of the cooking, and then performs controlling for the time of the cooking, in time series, and when the determination unit determines that said another remainder time is not more than said another ON time, the control unit adds said another remainder time determined to be not more than said another ON time onto an ON time in a first on/off cycle within the time of the cooking.

5. A high frequency cooking apparatus according to claim 4, wherein when the determination unit determines that said another remainder time is more than said another ON time, the control unit modifies an OFF time in a last on/off cycle within said another time of the cooking to be said another remainder time determined to be more than said another ON time from which said another ON time has been subtracted.

6. A high frequency cooking apparatus according to claim 4, further comprising:

a rise time setting unit that sets a rise time for the heating performed by the high frequency generator, wherein the control unit subtracts the rise time from the remainder time determined to be not more than the ON time, before adding the remainder time determined to be not more than the ON time.

7. A high frequency cooking apparatus according to claim 4, further comprising:

a rise time setting unit that sets a rise time for the heating performed by the high frequency generator, wherein the control unit subtracts the rise time from said another remainder time determined to be not more than said another ON time, before adding said another remainder time determined to be not more than said another ON time.

8. A high frequency cooking apparatus according to claim 1, further comprising:

a rise time setting unit that sets a rise time for the heating performed by the high frequency generator, wherein the control unit subtracts the rise time from the remainder time determined to be not more than the ON time, before adding the remainder time determined to be not more than the ON time.

* * * * *